US005785896A

United States Patent [19]

Rother et al.

[11] Patent Number: 5,785,896

[45] Date of Patent: Jul. 28, 1998

[54] MIXTURE FOR INHIBITION OF CORROSION OF METALS

[75] Inventors: Heinz-Joachim Rother, Krefeld; Franz Kunisch, Odenthal, both of Germany

[73] Assignee: Bayer Aktiengesellschaft, Leverkusen, Germany

[21] Appl. No.: 551,187

[22] Filed: Oct. 31, 1995

[30] Foreign Application Priority Data

Nov. 3, 1994 [DE] Germany ..... 44 39 193.5

[51] Int. Cl.[6] ..... C23F 11/06; C09K 15/30; C09K 15/06

[52] U.S. Cl. ..... 252/392; 252/390; 252/394; 252/396; 422/12; 422/16; 422/17; 106/14.13; 106/14.16

[58] Field of Search ..... 252/390, 394, 252/392 A, 51.5 A, 396; 422/16, 17, 12; 106/14.13, 14.16

[56] References Cited

U.S. PATENT DOCUMENTS

| | | | |
|---|---|---|---|
| 2,618,606 | 11/1952 | Schaeffer | 252/137 |
| 3,933,531 | 1/1976 | Sawa et al. | 148/6.14 R |
| 4,522,785 | 6/1985 | D'Errico | 422/12 |
| 4,595,523 | 6/1986 | Knepper et al. | 252/390 |
| 4,839,461 | 6/1989 | Boehmke | 528/363 |
| 4,994,197 | 2/1991 | Blain et al. | 252/51.5 A |
| 5,362,411 | 11/1994 | Bergstra et al. | 252/51.5 A |
| 5,531,934 | 7/1996 | Freeman et al. | 252/390 |

FOREIGN PATENT DOCUMENTS

| | | | |
|---|---|---|---|
| 0651052 | 5/1995 | European Pat. Off. | C11D 17/00 |
| 0672625 | 9/1995 | European Pat. Off. | C02F 5/12 |
| 4244031 | 6/1994 | Germany | C08G 69/08 |
| 4305368 | 8/1994 | Germany | C08G 69/10 |
| 60-251288 | 12/1985 | Japan . | |
| 63-199261 A | 8/1988 | Japan . | |
| 1061904 | 1/1963 | United Kingdom | C10M 1/32 |
| 1347008 | 11/1970 | United Kingdom | C11D 7/32 |

OTHER PUBLICATIONS

J. Kovacs, et al., J. Org. Chem., vol. 26, pp. 1084–1091, (1961).

English Translation for EP 604 813. (1993).

B.J. Little, et al., in "American Chemical Society Symposium", vol. 444, pp. 263–279, (1991).

Derwent Abstract, abstract of JP 06–248 075, (1994).

Derwent Abstract, abstract of JP 06–298 930, (1994).

*Primary Examiner*—Sharon Gibson
*Assistant Examiner*—Deanna Baxam
*Attorney, Agent, or Firm*—Sprung Kramer Schaefer & Briscoe

[57] ABSTRACT

A method of combating corrosion of a metal which comprises contacting such metal with a composition containing polyamino acids, their salts and their anhydrides, together with at least one corrosion inhibitor selected from the group consisting of benzotriazole, 4-$C_1$–$C_4$-alkylbenzotriazoles and 5-$C_1$–$C_4$-alkylbenzotriazoles.

2 Claims, No Drawings

MIXTURE FOR INHIBITION OF CORROSION OF METALS

The invention relates to the use of mixtures of polyamino acids and customary corrosion inhibitors for inhibition of corrosion of metals.

It is known that organic compounds can be used as metal passivators, for example for copper or brass, in functional media, such as hydraulic liquids or in antifreeze solutions, for protection of surfaces against corrosion. Known compounds for this purpose include, for example, benzimidazole, benzothiazole and benzotriazole derivatives.

The compounds mentioned last are described, for example, in British patent specification 1 061 904. However, benzotriazole itself and many of its derivatives can be used in their applications only with limitation because of their low solubility, in particular in aqueous systems.

Metal passivators which have a high solubility, so that they can be distributed rapidly and readily in the media in which they are employed and thereby guarantee optimum protection for the metal objects, are particularly advantageous for such functional media It is known from EP-A 604 813 that polyaspartic acid is active as a corrosion inhibitor above all for brass. Surprisingly, it has now been found that poly-$C_4$–$C_5$-amino acids in combination with customary corrosion inhibitors farther improve the action thereof.

The invention thus relates to the use of mixtures of

A. 1 to 99 percent by weight, preferably 20 to 80 percent by weight, of poly-$C_4$–$C_5$-amino acid and B. 1 to 99 percent by weight, preferably 20 to 80 percents by weight, of at least one corrosion inhibitor which differs from A, the percentages being based on the total amount of A+B for inhibition of corrosion of metals.

Preferred polyamino acids A include, above all, polyaspartic acid and polyglutamic acid and the salts of these acids and their anhydrides, such as, for example, polysuccinimide. The sodium and potassium salts are preferred salts.

The preparation of polyaspartic acid and its derivatives have been the subject of numerous publications for a long time. The preparation can thus be carried out by thermal polycondensation of aspartic acid (J. Org. Chem. 26, 1084 (1961).

U.S. Pat. No. 4,839,461 (=EP-A 256 366) describes the preparation of polyaspartic acid from maleic anhydride, water and ammonia. In this preparation, maleic anhydride is converted into the monoammonium salt in an aqueous medium by addition of concentrated ammonia solution.

This maleic acid monoammonium salt can preferably be subjected to thermal, optionally continuous polymerization at 150° to 180° C. in a reactor over a residence time of 5 to 300 minutes, and the resulting polysuccinimide can be converted into polyaspartic acid or a salt thereof by hydrolysis.

In a preferred embodiment, the polyaspartic acid essentially contains repeating units of the following structure:

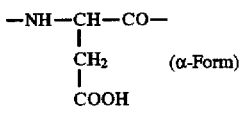

a)

(α-Form)

and

-continued

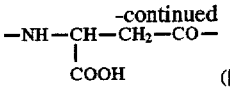

b)

(β-Form).

The content of the β-form is in general more than 50%, in particular more than 70%, based on the sum of a+b.

In addition to the repeating aspartic acid units a) and b), the polyaspartic acid can contain further repeating units, for example c) malic acid units of the formulae

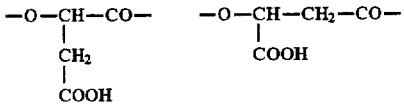

d) maleic acid units of the formula

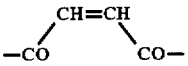

e) fumaric acid units of the formula

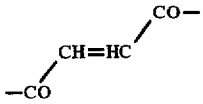

The polyaspartic acid can contain the "further" repeating units in amounts of up to 100% by weight, based on the sum of a+b.

Preferred polyamino acids A have molecular weights, determined as the weight-average by gel permeation chromatography (calibrated with polystyrene) of 500 to 10,000, preferably 1000 to 5000, in particular 2000 to 4000.

Preferred corrosion inhibitors B are polyphosphates, molybdates, chromates, zinc salts, sodium metasilicates, benzoates, phosphonates, such as aminomethylenephosphonate (AMP), aromatic azoles, such as optionally substituted bezimidazoles, benzothiazoles and benzotriazoles, such as mercaptobenzothiazole, benzotriazole and 4- and 5-$C_1$–$C_4$-alkylbenzotriazoles, such as 4methylbenzotriazole, 5-methylbenzotriazole and the mixtures of these isomers and 4-butylbenzotriazole, homo- and copolymers based on acrylic acid, methacrylic acid and/or maleic acid, ligninsulphonates, tannins, complexing agents, citric acid, tartaric acid and gluconic acid. Particularly preferred corrosion inhibitors B are benzotriazole and 4- and 5-methylbenzotriazole.

The components of the mixtures to be used according to the invention can be added individually or as a mixture, in solid form or as a solution or dispersion in a liquid, preferably water, to the medium in which they are to act.

The amount of the mixture to be used can be 0.1 mg to 10 g, preferably 1 mg to 0.1 g, in each case per kg of the medium in which they are to act.

Additional auxiliaries which increase the use properties of the mixtures according to the invention or their aqueous solutions can be added to these as required. In this way, for example, wetting can be improved, the growth of microorganisms can be suppressed (addition of microbicides) or the separating out of precipitates of substances which are dissolved in the aqueous substances can be prevented.

EXAMPLES

1. Test for Inhibition of Corrosion on Brass

Bright and degreased brass specimens were used for the corrosion test. Simulated seawater according to ASTM D 665-IP 135, to which the substance to be investigated was added, was used as the test solution. During the test duration of 7.5 hours, the metal specimens were immersed completely in the 55° C. hot test solution, into which about 100 ml of air/minute were passed.

After the test, the specimens were cleaned in 18% by weight strength hydrochloric acid for 15 seconds and washed with acetone and water. The dry metal samples were weighed before and after the test. The percentage protective action S, based on a blank test, was calculated from the loss in mass:

$$S = \frac{m - m_1}{m} \times 100$$

wherein m=loss in mass of the metal specimen without inhibitor (blank test) and $m_1$=loss in mass of the metal specimen with inhibitor.

The results of the percentage protective action are shown in the following Table.

TABLE 1

| Polyaspartic acid Na salt | Tolyltriazole | % protective action |
|---|---|---|
| 10 mg/l | — | 46.2 |
| — | 1 mg/l | 64.6 |
| 10 mg/l | 1 mg/l | 80.5 |

2. Test for Inhibition of Corrosion on Copper

Bright and degreased copper specimens were tested by the method described under 1). The results are shown in the following table.

TABLE 2

| Polyaspartic acid Na salt | Tolyltriazole | % protective action |
|---|---|---|
| 25 mg/l | — | 0 |
| — | 2 mg/l | 53 |
| 10 mg/l | 2 mg/l | 79.4 |

We claim:

1. A method of combatting the corrosion of a metal which comprises contacting such metal with a composition comprising A. 51 to 80 percent by weight of at least one member rejected from the group consisting of polyaspartic acid, a salt thereof, polyglutamic acid, a salt thereof and succinimide and B. 20 to 49 percent by weight of at least one corrosion inhibitor selected from the group consisting of benzotriazole, 4-$C_1$–$C_4$-alkylbenzotriazoles and 5-$C_1$–$C_4$-alkylbenzotriazoles.

2. The method according to claim 1, wherein A comprises repeating units of

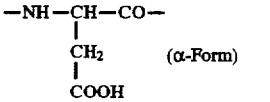

a) (α-Form)

and

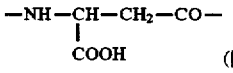

b) (β-Form).

* * * * *

UNITED STATES PATENT AND TRADEMARK OFFICE

CERTIFICATE OF CORRECTION

PATENT NO : 5,785,896

DATED : July 28, 1998

INVENTOR(S): Heinz-Joachim Rother, et al.

It is certified that error appears in the above-identified patent and that said Letters Patent is hereby corrected as shown below:

| | |
|---|---|
| Col. 4, Line 16 | Delete "rejected" and substitute --selected-- |

Signed and Sealed this

Seventeenth Day of August, 1999

*Attest:*

*Attesting Officer*

Q. TODD DICKINSON

*Acting Commissioner of Patents and Trademarks*